US005551754A

United States Patent [19]

Neumueller

[11] Patent Number: 5,551,754

[45] Date of Patent: Sep. 3, 1996

[54] HEIGHT ADJUSTMENT FOR THE BACKS OF CHAIRS

[75] Inventor: Konrad Neumueller, deceased, late of Burgthann, Germany, by Maria Neumueller, Angelika Gebhard, heirs

[73] Assignee: SifaSitefabrik GmbH, Sulzbach-Rosenberg, Germany

[21] Appl. No.: 324,000

[22] Filed: Oct. 17, 1994

[30] Foreign Application Priority Data

Oct. 15, 1993 [DE] Germany ..... 43 35 320.7

[51] Int. Cl.[6] ..... A47C 1/00

[52] U.S. Cl. ..... 297/353; 297/463.1

[58] Field of Search ..... 297/353, 410, 297/463.1, 338, 344.2; 248/412, 411, 414, 245, 118.3; 321/322

[56] References Cited

U.S. PATENT DOCUMENTS

| | | | |
|---|---|---|---|
| 1,336,510 | 4/1920 | Collier . | |
| 3,526,430 | 9/1970 | Eldon | 297/353 |
| 4,236,609 | 12/1980 | Carlson | 248/411 X |
| 4,596,484 | 6/1986 | Nakatami | 248/411 X |
| 4,616,877 | 10/1986 | Slaats et al. | 297/353 |
| 4,647,108 | 3/1987 | Hayashi | 297/410 X |
| 5,007,678 | 4/1991 | DeKraker | 297/353 |
| 5,035,466 | 7/1991 | Mathews et al. | 297/353 X |
| 5,232,265 | 8/1993 | Estkowski et al. | 297/353 |
| 5,382,077 | 1/1995 | Stumpf et al. | 248/412 X |

FOREIGN PATENT DOCUMENTS

| | | |
|---|---|---|
| 2218894 | 10/1973 | Germany . |
| 3939321 | 5/1991 | Germany . |

*Primary Examiner*—Milton Nelson, Jr.
*Attorney, Agent, or Firm*—Morrison Law Firm

[57] ABSTRACT

A height-adjusting mechanism for the back rests of chairs, where the back rest comprises a back plate, which may be padded, connected to a fastening element that slides lengthwise on a back rest carrier and the back rest carrier and the fastening element are clamped together. The mechanism comprises a clamping body on the side of the fastening element that is opposite the back plate. The clamping body has at least one continuous hole or slot. The end of at least one anchor passes through a hole or slot of the fastening element, where it is held by undercuts, while the other end of the anchor passes through the clamping body and is connected via a hole and a bolt with a lever. The lever is pivotably mounted about the bolt and has a lug. The lug can be swivelled between the bolt and the clamping body, by which the tractive force applied to the anchor and the pressure applied at the same time to the clamping body lock the fastening element and the back rest carrier to each other.

10 Claims, 4 Drawing Sheets

HEIGHT ADJUSTMENT FOR THE BACKS OF CHAIRS

BACKGROUND OF THE INVENTION

This invention relates to a height adjustment for the back rests of chairs, especially of office swivel chairs.

Screw-clamping devices are known for adjusting the height of a back rest that comprises a back plate (which may be padded) connected to a fastening element that slides lengthwise on a back rest carrier, where the back rest carrier and the fastening element are clamped together.

Several prior inventions have tried to increase the ease of operation of such a height adjusting mechanism, for example, by having a sitting person adjust the back rest with a hand wheel and a spindle (German patent DE-A-39 39 321). Another example shows the clamping of a slideable bar that carries the back rest with two pivotably mounted angle irons prestressed by a tension spring, so that the angle irons are clamped contiguously to recesses of the bar and can be disconnected from the bar by means of a push-button (German patent DE-A-22 18 894). None of the existing devices are satisfactory.

OBJECTS AND SUMMARY OF THE INVENTION

An object of the invention is to adjust the height of the back rest of a chair, especially an office swivel chair, by a mechanism that is easy to operate and simple to adapt to various back rest carriers.

Briefly stated, the present invention provides a height-adjusting mechanism for the back rests of chairs, where the back rest comprises a back plate, which may be padded, connected to a fastening element that slides lengthwise on a back rest carrier and the back rest carrier and the fastening element are clamped together. The mechanism comprises a clamping body on the side of the fastening element that is opposite the back plate. The clamping body has at least one continuous hole or slot. The end of at least one anchor passes through a hole or slot of the fastening element, where it is held by undercuts, while the other end of the anchor passes through the clamping body and is connected via a hole and a bolt with a lever. The lever is pivotably mounted about the bolt and has a lug. The lug can be swivelled between the bolt and the clamping body, by which means the tractive force applied to the anchor and the pressure applied at the same time to the clamping body lock the fastening element and the back rest carrier to each other.

According to an embodiment of the invention, a height-adjusting mechanism for the back rest of a chair comprises: a back plate; a fastening element connected to The back plate; the fastening element slidably mounted on a back rest carrier to slide lengthwise thereon; means for clamping the back rest carrier and the fastening element; the means for clamping comprising a clamping body mounted on a side of the fastening element opposite the back rest; the clamping body having at least one continuous slot; at least one anchor; one end of the at least one anchor passing through a slot in the fastening element and held therein by undercuts; another end of the anchor passing through the at least one continuous slot and connecting to a lever; the lever being pivotably mounted; and the lever having a lug that swivels between the bolt and the clamping body, whereby tractive force applied to the anchor and pressure applied to the clamping body clamp the fastening element and the back rest carrier to each other.

According to the invention, the locking means of the height adjustment for the back rest of a chair comprises a clamping body arranged on the side of the fastening element opposite the back plate. The clamping body has at least one continuous hole or slot. The end of at least one anchor passes through a hole or slot in the fastening element and is held therein by means of undercuts. The other end of the anchor passes through the clamping body and is connected to a lever by a bolt. The lever is pivotably mounted about the bolt and has a lug which can be swivelled between the bolt and the clamping body. Thus the tractive force applied to the anchor and the pressure applied at the same time to the clamping body lock the fastening element and the back rest carrier against each other. It is advantageous when the lug swivels over a short distance about the highest pressure point and then assumes a detent position.

It is also advantageous when the height of the clamping body can be adjusted between the fastening element and the bolt.

According to a preferred embodiment of the invention, the clamping body comprises two contiguous parts that move against each other on an inclined plane. Between stops of both parts there is at least one pressure spring that tends to force both parts apart along the incline. With this arrangement, the clamping means is automatically reset, because the pressure spring always presses the clamping body against the fastening element and the lug and there is enough play between the two parts of the clamping body to reset it. The contiguous parts of the clamping body can also be provided with matching detent means, such as steps or teeth.

According to another embodiment of the invention, the clamping body is an elastic element made of hard rubber or an elastomer.

According to another preferred embodiment of the invention, a pressure body is between the lug of the lever and the clamping body. This pressure body can, for example, be pivotably mounted on one side to lateral necks of the lug of the lever, while its other side is rounded and lies in a hollow of the clamping body. The pressure body can be brought into a clamping detent position when the lug swivels across the highest pressure point of lug and pressure body.

Preferably, to increase ease of operation, at least one pressure spring is arranged between an upper region of the back rest carrier and a lower region of the fastening element.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
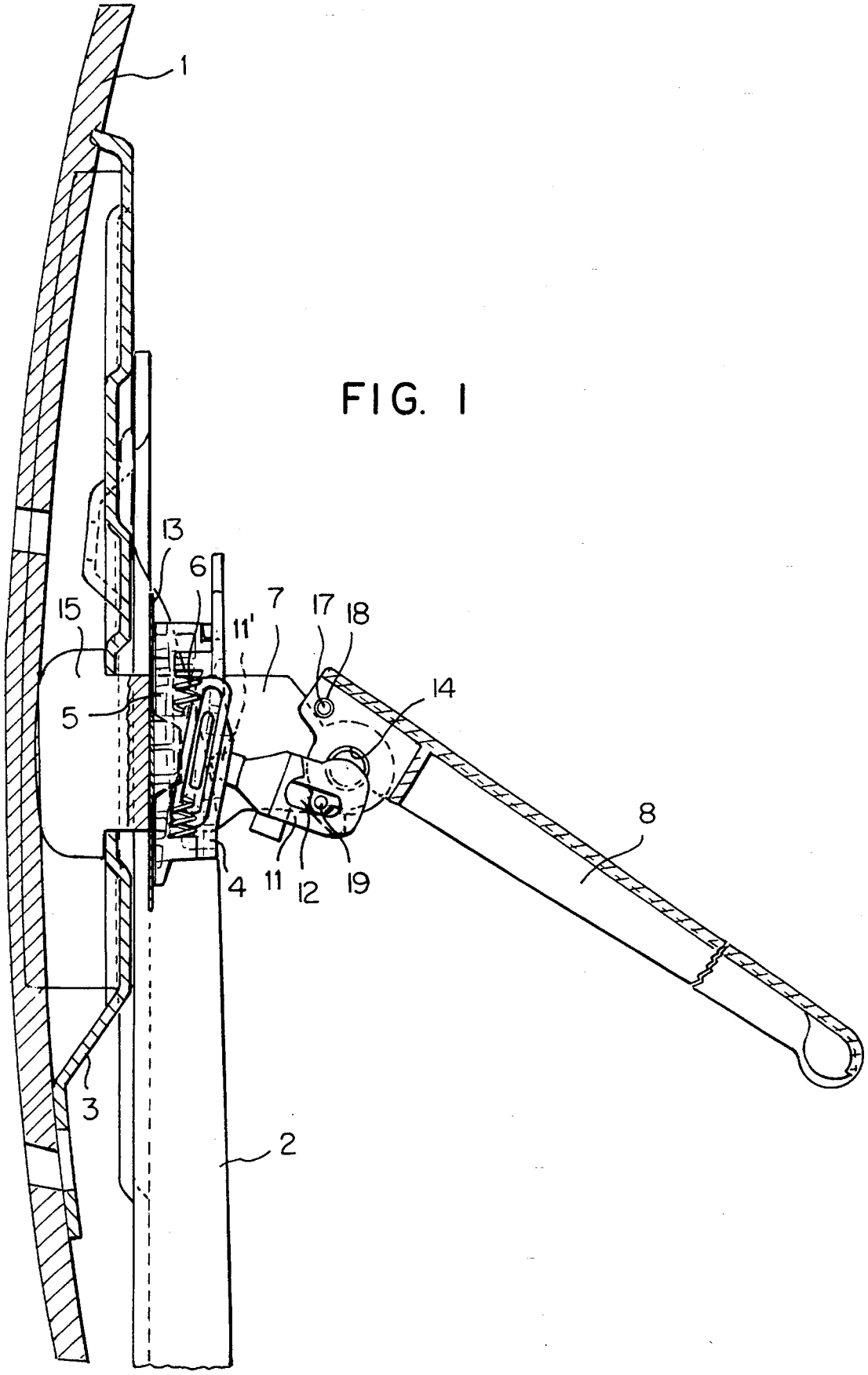
FIG. 1 is a lateral view of the height adjustment mechanism of the present invention in opened position.
Figure 2:
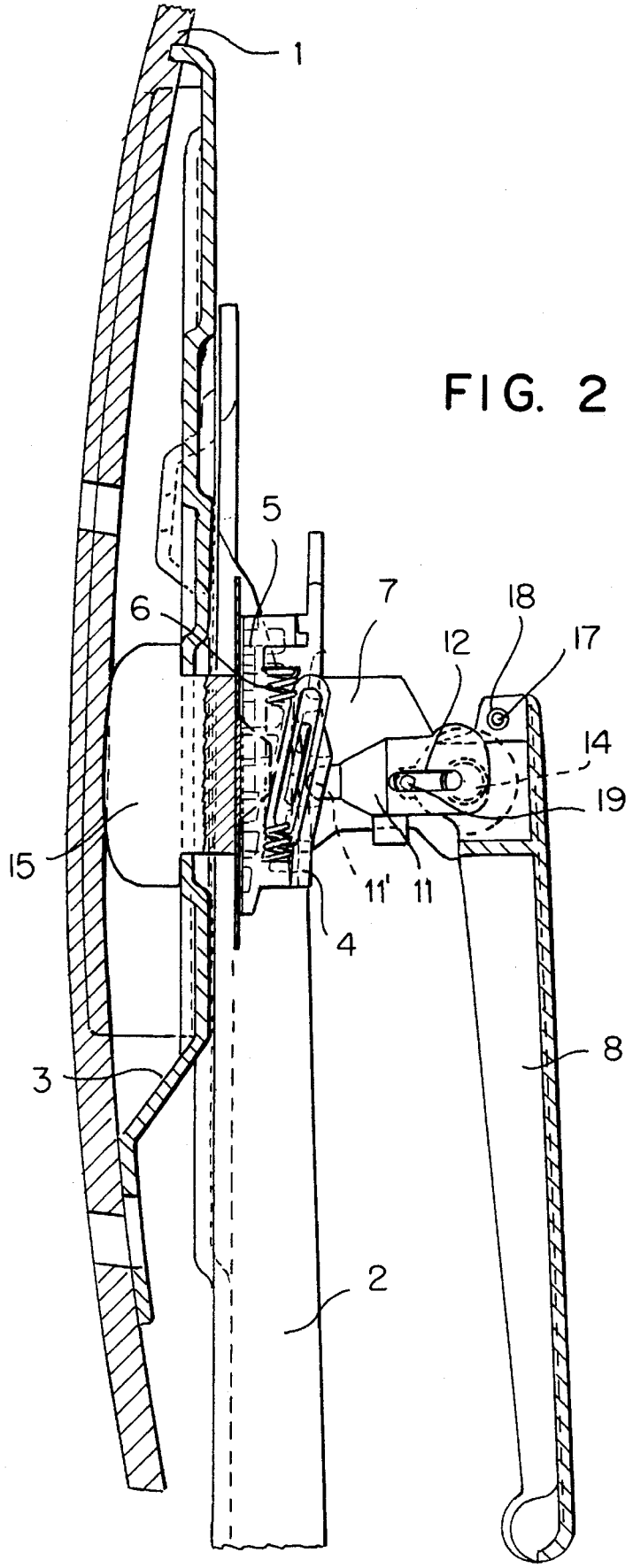
FIG. 2 is a lateral view of the mechanism of FIG. 1 in clamped position.
Figure 3:
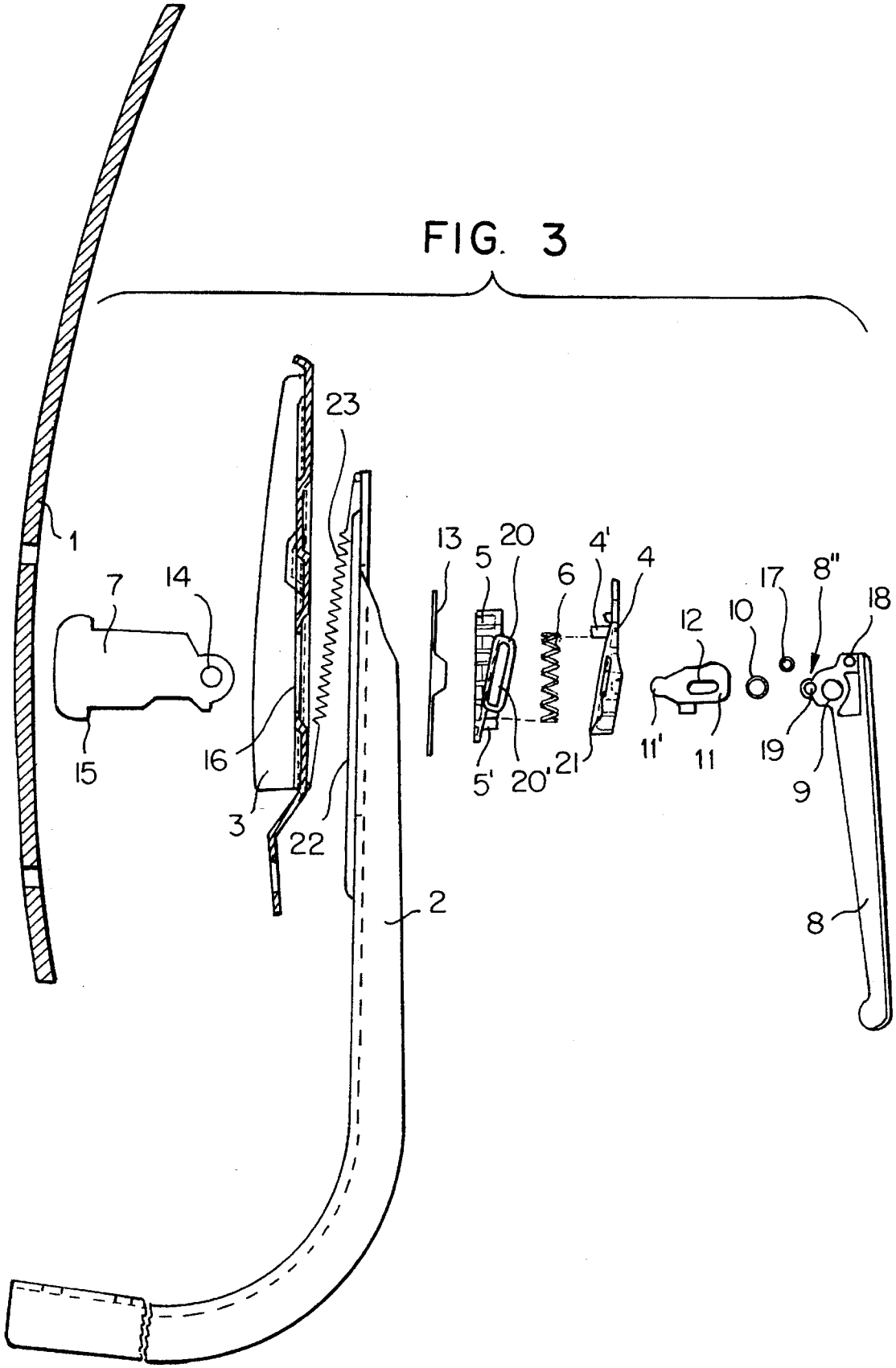
FIG. 3 is an exploded view of the height adjustment mechanism.

Referring to FIGS. 1–3, the height-adjusting mechanism is shown with a back rest comprising a back plate 1, a back rest carrier 2, and a fastening element 3. Back plate 1, which can be a wooden panel or a plastic or metal shell, is bolted to fastening element 3, which is flat. Fastening element 3, which can be made of metal or plastic, bears against back rest carrier 2. Between fastening element 3 and back rest carrier 2 are arranged sliding surfaces that at least match each other in profile. Fastening element 3 and back rest carrier 2 are connected by the clamping means shown in opened position in FIG. 1 and in closed position in FIG. 2. One side of the clamping means is formed by undercuts 15 of an anchor 7. A first end of anchor 7 passes through a pair of slots in fastening element 3 and back rest carrier 2. A slot 16 in fastening element 3 is designed so that the undercuts 15 of anchor 7 come to bear against and beside slot 16. A slot 22 in back rest carrier 2 runs the length along which the back rest can move along back rest carrier 2, a length of at most three times the length of the back rest. Slot 16 and slot 22 are the slots through which the free end of anchor 7 passes.

Figure 4:
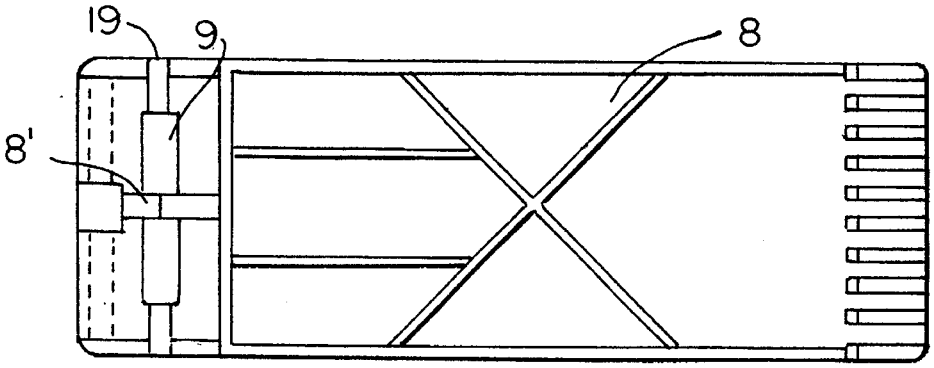
FIG. 4 is a bottom view of the lever of the present invention.
Figure 5A:
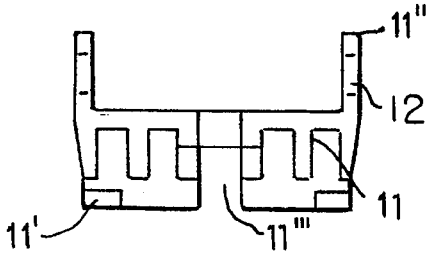
FIG. 5*a* is a front view of the pressure body of the present invention.

Referring also to FIG. 4, anchor 7 has at its other end a hole 14 (FIG. 3) by which anchor 7 is engaged in a centered recess 8' in a lug 8" (which in clamped position is directed toward fastening element 3) of a lever 8. Lever 8 has holes 9 lateral to recess 8'. A bolt 10 passes through holes 9 and hole 14 so that lever 8 is pivotably mounted in anchor 7. Further out on lever 8, lug 8" has necks 19. Necks 19 fit into oblong holes 12 in laterally turned-up flaps 11" of a pressure body 11 (shown in detail in FIGS. 5*a*, 5*b* and 5*c*) whose other, rounded end 11' lies in a hollow of the clamping body. Pressure body 11 is provided with a centered recess 11'" for anchor 7.

Figure 5D:
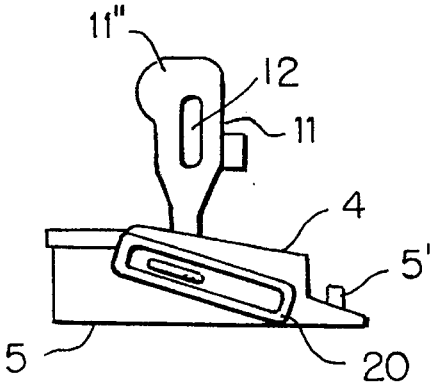
FIG. 5*d* is a side elevation view depicting the assembly relationship of the pressure body and the two rectangular parts of which the clamping body is comprised.
Figure 5B:
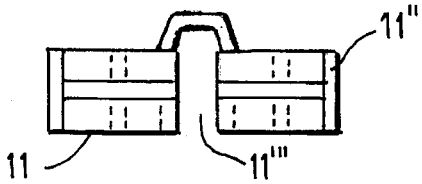
FIG. 5*b* is a top plan view of the pressure body.
Figure 5C:
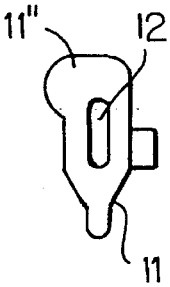
FIG. 5*c* is a side elevation view of the pressure body.

The clamping body should be formed from an elastic material such as hard rubber or an elastomer. The clamping body consists of two rectangular parts 4, 5, each of triangular section. Parts 4, 5 form two inclined surfaces by which they bear against each other to form an approximately rectangular section. Parts 4, 5 can slide against each other on the inclined surfaces. Parts 4, 5 are held together and limited in their movement because part 4 has a neck 21 laterally and part 5 has upright webs 11 with oblong holes 17. FIG. 5*d* shows an assembly relation ship of parts 4, 5 with pressure body 11.

Figure 6:
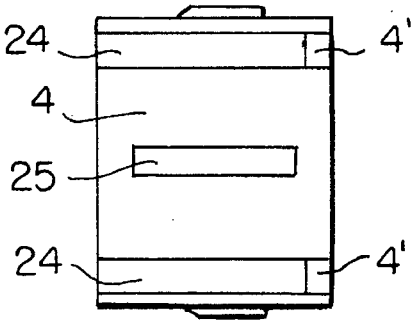
FIG. 6 is a bottom view of a part of the clamping body of the present invention.

Referring also to FIG. 6, the inclined surfaces of part 4 have oblong grooves 24, each of which has, at the flat end of part 4, a stop 4'. Similarly, the inclined surfaces of part 5 have, at the flat end, stops 5'. Pressure springs 6, between parts 4 and 5, tend to force parts 4, 5 apart along their inclines. Thus the two parts 4, 5 of the clamping body tend to reach a greater height overall than fastening element 3. By this means the original clamping force, which is reduced by wear or fatigue of the individual parts, is always restored by a quasi-growing clamping body. Both parts 4, 5 of the clamping body have centered slots 25 for anchor 7. Inserted between the clamping body and fastening element 3 is a slotted spacer plate 13.

In opened position, lever 8 is turned outward about bolt 10 to bring pressure body 11 into an inclined position via necks 19 in oblong holes 12 of pressure body 11. A bolt 17, inserted into holes 18 in the flanges of lever 8, acts as a stopper. No clamping action takes place between the undercuts 15 of anchor 7 and the clamping body parts 4, 5. The back rest can slide along back rest carrier 2. Laterally suspended, between a lower region of fastening element 3 and an upper region of back rest carrier 2, are tension springs 23 (shown in FIG. 3, which tend to pull fastening element 3 upward.

To clamp the back rest, lever 8 swivels downward. Via necks 19 in oblong holes 12 of pressure body 11, lever 8 pulls pressure body 11 into a position more or less vertical in relation to fastening element 3. The articulated application of pressure body 11 between lug 8" of lever 8 and the clamping body results in a snapping effect, by which the user is able to feel the adjusting function. By swivelling pressure body 11, a tractive force is applied to anchor 7. At the same time pressure is applied to the clamping body, which results in clamping the back rest to back rest carrier 2. Pressure body 11, by moving a minimum distance beyond the greatest pressure point, slides into a detent position.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A height-adjusting mechanism for the back rest of a chair, which comprises:

a back plate;

a fastening element connected to said back plate;

said fastening element being slidably mounted on a back rest carrier to slide lengthwise thereon;

means for clamping said back rest carrier and said fastening element;

said means for clamping comprising a clamping body mounted on a side of said fastening element opposite said back plate;

said clamping body having at least one continuous slot;

at least one anchor;

one end of said at least one anchor passing through a slot in said fastening element and held therein by undercuts;

another end of said anchor passing through said at least one continuous slot and connecting to a lever;

said lever being pivotably mounted on a bolt; and said lever having a lug that swivels between said bolt and said clamping body, whereby tractive force is applied to said anchor and pressure is applied to said clamping body to clamp said fastening element and said back rest carrier to each other.

2. Mechanism according to claim 1, wherein the height of said clamping body can be adjusted between said fastening element and said bolt.

3. Mechanism according to claim 2, wherein:

said clamping body further comprises two contiguous parts which can move against each other on an inclined plane; and at least one pressure spring is fitted between stops of said two contiguous parts, thereby forcing said two contiguous parts apart along said inclined plane.

4. Mechanism according to claim 3, wherein said two contiguous parts have each a detent means.

5. Mechanism according to claim 2, wherein said clamping body is elastic.

6. Mechanism according to claim 2, wherein said clamping body is made of hard rubber.

7. Mechanism according to claim 2, wherein said clamping body is made from an elastomer.

8. Mechanism according to claim 1, wherein a pressure body is located between said lug and said clamping body.

9. Mechanism according to claim 8, wherein:

said pressure body is pivotably mounted on a first side thereof to lateral necks of said lug;

a second side of said pressure body is rounded and lies in a hollow of said clamping body;

said pressure body moves into a clamping detent position when said lug is swivelled across its highest pressure point and said pressure body.

10. Mechanism according to claim 1, wherein at least one tension spring is located between an upper region of said back rest carrier and a lower region of said fastening element.

* * * * *